US008134521B2

(12) United States Patent
Herz et al.

(10) Patent No.: US 8,134,521 B2
(45) Date of Patent: Mar. 13, 2012

(54) ELECTRONICALLY TUNABLE MICROWAVE REFLECTOR

(75) Inventors: Paul R. Herz, Malibu, CA (US); Daniel Sievenpiper, Los Angeles, CA (US)

(73) Assignee: Raytheon Company, Waltham, MA (US)

( * ) Notice: Subject to any disclaimer, the term of this patent is extended or adjusted under 35 U.S.C. 154(b) by 233 days.

(21) Appl. No.: 11/980,913

(22) Filed: Oct. 31, 2007

(65) Prior Publication Data

US 2009/0109121 A1 Apr. 30, 2009

(51) Int. Cl.
*H01Q 15/14* (2006.01)

(52) U.S. Cl. ..... 343/912; 343/700 MS; 343/787

(58) Field of Classification Search ..... 343/909, 343/745, 754
See application file for complete search history.

(56) References Cited

U.S. PATENT DOCUMENTS

| | | | | |
|---|---|---|---|---|
| 4,404,490 | A * | 9/1983 | Taylor et al. | 310/339 |
| 4,905,014 | A | 2/1990 | Gonzalez et al. | |
| 6,175,337 | B1 * | 1/2001 | Jasper et al. | 343/770 |
| 6,538,621 | B1 * | 3/2003 | Sievenpiper et al. | 343/909 |
| 6,552,696 | B1 * | 4/2003 | Sievenpiper et al. | 343/909 |
| 7,068,234 | B2 * | 6/2006 | Sievenpiper | 343/745 |
| 7,136,029 | B2 * | 11/2006 | Ramprasad et al. | 343/909 |
| 7,215,007 | B2 * | 5/2007 | McKinzie et al. | 257/664 |
| 7,903,040 | B2 * | 3/2011 | Gevorgian et al. | 343/787 |
| 2002/0167456 | A1 * | 11/2002 | McKinzie, III | 343/909 |
| 2006/0256014 | A1 * | 11/2006 | Sengupta et al. | 343/700 MS |
| 2007/0182639 | A1 | 8/2007 | Sievenpiper et al. | |

* cited by examiner

*Primary Examiner* — Shawki S Ismail
*Assistant Examiner* — Crystal L Hammond
(74) *Attorney, Agent, or Firm* — Christie, Parker & Hale, LLP

(57) ABSTRACT

Exemplary embodiments of a structured surface are described which can efficiently reflect, steer or focus incident electromagnetic radiation. The surface impedance may be adjustable and can impart a phase shift to the incident wave using tunable electrical components of the surface. An array of electrodes interconnected by variable capacitors may be used for beam steering and phase modulation. In an exemplary embodiment, the electrodes have a circular configuration.

15 Claims, 3 Drawing Sheets

ELECTRONICALLY TUNABLE MICROWAVE REFLECTOR

BACKGROUND

Ordinary metal surfaces reflect electromagnetic radiation with a π phase shift. Artificial materials are described, e.g. in U.S. Pat. No. 6,538,621 and U.S. Pat. No. 6,552,696, which are capable of reflecting, steering or focusing RF radiation with a variable phase shift. By programming the reflection phase as a function of position on the surface, a reflected beam can be steered or focused.

SUMMARY

An exemplary embodiment of an electronically tunable microwave reflector includes a ground plane surface, and an array of generally flat, metal plate elements arranged in a two-dimensional lattice spaced from the ground plane surface by a distance less than a wavelength of microwave energy to be reflected by the reflector. In an exemplary embodiment, the metal plates have a circular disk configuration, with a diameter less than the operating wavelength. A plurality of variable capacitance structures are arranged for controllably varying a capacitance between at least adjacent ones of the plurality of metal plate elements.

BRIEF DESCRIPTION OF THE DRAWINGS

Features and advantages of the disclosure will readily be appreciated by persons skilled in the art from the following detailed description when read in conjunction with the drawing wherein.

DETAILED DESCRIPTION

Figure 1A:
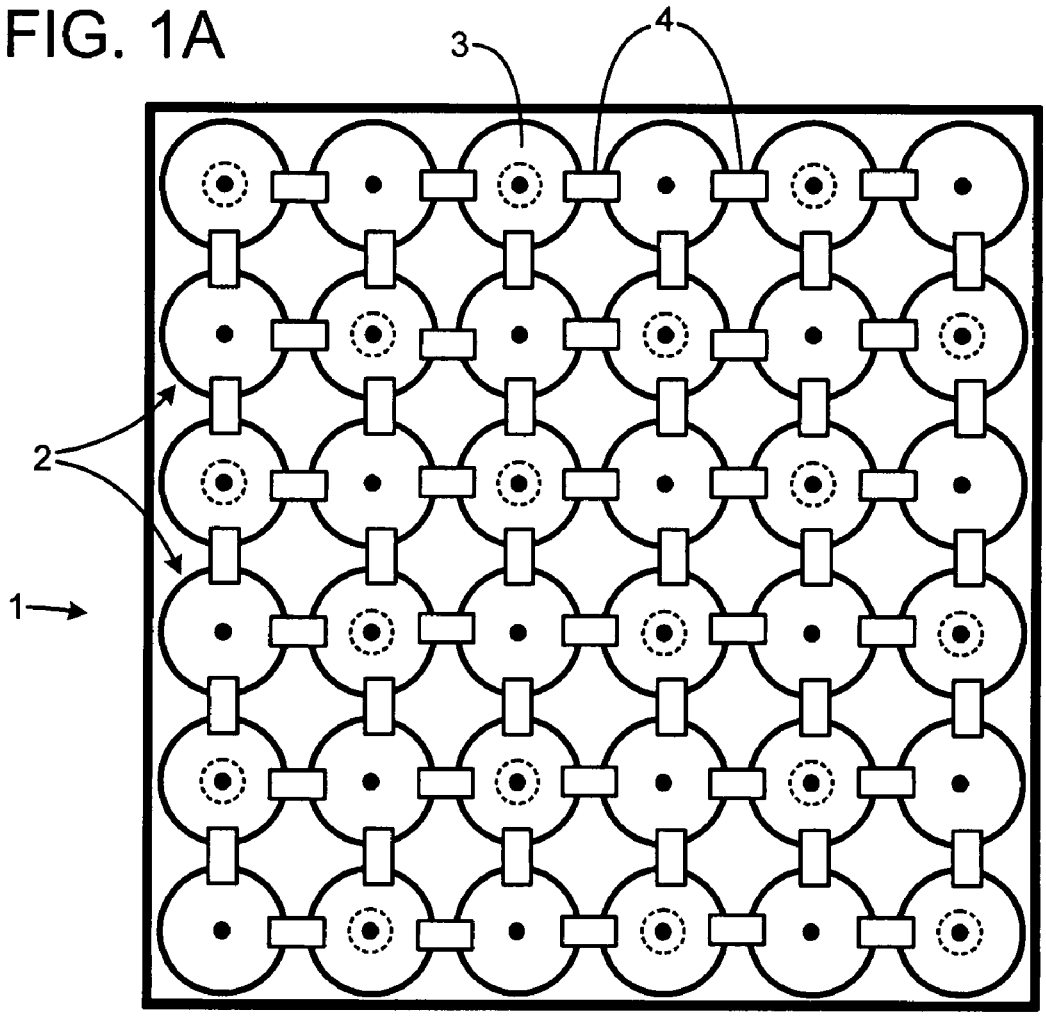
FIG. 1A is a diagrammatic top view illustrating fan exemplary embodiment of a tunable surface.

In the following detailed description and in the several figures of the drawing, like elements are identified with like reference numerals. The figures are not to scale, and relative feature sizes may be exaggerated for illustrative purposes.

Exemplary embodiments of a structured surface are described which can efficiently reflect, steer or focus incident electromagnetic radiation over a broad spectral range. The surface impedance may be adjustable and can impart an almost arbitrary phase shift to the incident wave using tunable electrical components of the surface. A planar array of electrodes interconnected by variable capacitors may be used for beam steering and phase modulation. In an exemplary embodiment, the electrodes are circular disk structures, and provide improved phase, beam steering and beam focusing performance of the tunable impedance surface. Because the performance of the surface is sensitive to impedance characteristics, the circular disk electrodes may provide improved capabilities, including one or more of the ability to modify reflection phase of the incident radiation over a larger frequency range, increased operational bandwidth of the tunable surface over a given range of radiation frequencies, and the capability to realize tunable surfaces over a larger span of frequencies in the electromagnetic spectrum.

FIG. 1A illustrates a simplified diagrammatic top view of an exemplary embodiment of a planar tunable surface 1 employing an array of electrodes having a circular disk-like configuration. In an exemplary embodiment, a tunable surface may be used in an electronically steerable antenna (ESA). The tunable surface may be capable of steering a beam of microwave or millimeter wave energy in one or two dimensions, using a set of electrical control signals. The surface 1 includes a substrate 12 (FIG. 1B), a ground plane 9 (FIG. 1B) on the back of the substrate, a periodic metallic pattern 2 on the front of the substrate, an array of metal elements or electrodes 3 within the metallic pattern 2 separated by variable reactances 4, a set of voltage control lines 5 (FIG. 1B) that are attached to the periodic metallic pattern 2 and that apply a set of bias voltages 6 to the variable reactances 4, and a circuit 7 that supplies the control voltages 6.

In an exemplary embodiment, the electrodes 3 are circular disks fabricated of an electrically conductive material, which covers all or substantially all of the area circumscribed by the circular perimeter of the electrode. The conductor pattern may be formed by a conductive layer formed on a top or upper surface of a substrate, and the layer may be patterned using photolithographic processes.

In an exemplary embodiment, the variable reactances 4 are variable reactance devices, which comprise a ferroelectric material, e.g. barium strontium titanate (BST). For example, the variable reactances may be varactor devices. Commonly assigned US 20070182639, the entire contents of which are incorporated herein by reference, describes exemplary techniques for fabrication of varactors for a tunable surface structure.

Figure 1B:
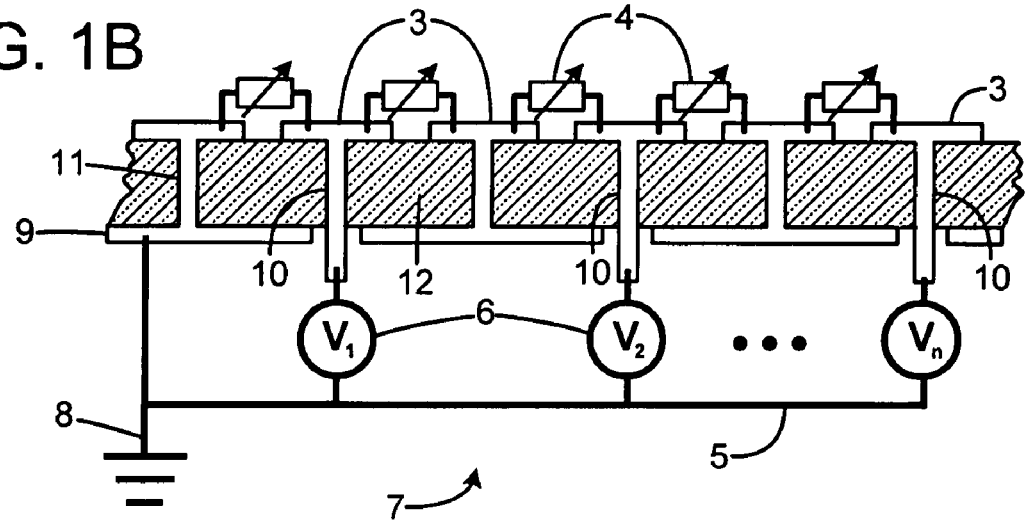
FIG. 1B is a schematic side view illustrating an equivalent circuit representation of features of the reflector of FIG. 1A.

FIG. 1B illustrates a simplified circuit diagram of the exemplary embodiment of FIG. 1A. In an exemplary embodiment, the tunable surface structure 1 includes a ground plane 9 connected to ground 8 and a series of electrically conductive elements or electrodes 3. The electrodes 3 are separated from the ground plane by a substrate 12 and the substrate may be perforated by vertical conductive vias 10 and 11. The vias 10 supply the control voltages 6 ($V_1, V_2 \ldots V_n$) to the alternating ones of the electrodes 3; the vias 11 connect the others of the electrodes to the ground plane 9. The electrodes 3 are interconnected with their neighbors by the variable reactances 4. The variable reactances 4 allow the capacitance between the neighboring electrodes 3 to be controlled with the control voltages 6 applied to respective ones of the electrodes 3. In this exemplary embodiment, half the electrodes are connected to ground plane 9 by conductive vias 11 in a metallic pattern 2 (FIG. 1A) which, in an exemplary embodiment, may be a checkerboard pattern. In an exemplary embodiment, only half the electrodes are attached to bias lines 5 by vias 10. In an exemplary embodiment, the dielectric substrate 12 may be a silicon wafer, and the electrodes 3 and ground plane 9 may be of any metal, e.g., platinum (PT) which may be coated with aluminum. The varactors 4 may be fabricated using a metal-BST-metal layer structure.

An exemplary embodiment of a tunable surface structure 1 may be considered as an array of metal protrusions or plates on a flat metal sheet. The surface may be fabricated using printed circuit technology, in which the vertical connections are formed as metal plated vias through a substrate 11, which connect the metal plates or electrodes 3 on the top surface to a solid conducting ground plane 9 on the bottom surface. The metal electrodes may be arranged in a two-dimensional lattice, as depicted in FIG. 1A. Both the diameter of the circular metal electrodes 3 and the thickness of the structure 1 measure much less than one wavelength.

The properties of the surface 1 may be explained using an effective medium model, in which it is assigned a surface impedance equal to that of a parallel resonant LC circuit. The use of lumped parameters to describe electromagnetic structures is valid when the wavelength is much less than the size of the individual features, as is the case here. When an electromagnetic wave interacts with the surface, it causes charges to build up on the ends of the top metal plates or electrodes. This process can be described as governed by an effective capacitance. As the charges travel back and forth, in response to a radio-frequency field, they flow around a long path through the vias and the bottom metal surface. Associated with these currents is a magnetic field, and thus an inductance. The inductance is still present if the vias are absent, and is then governed by the currents flowing in the upper and lower metal plates.

The presence of the array of resonant LC circuits affects the reflection phase of the surface. Far from resonance, the surface reflects RF waves with a pi phase shift, just as an ordinary conductor does. At the resonance frequency, the surface reflects with a zero phase shift. As the frequency of the incident wave is tuned through the resonance frequency of the surface, the reflection phase changes by one complete cycle, or 2 $\pi$. When the reflection phase is near zero, the structure effectively suppresses surface waves, which has been shown to be significant in antenna structures.

Tunable surface structures may be constructed in a variety of forms, including multi-layer versions with overlapping capacitor electrodes. Resonance frequencies may range from the hundred MHz range to tens of GHz.

In an exemplary embodiment, a tunable, beam-steering antenna or reflector may include metal electrodes and capacitors which are smaller than the operating wavelength. A tunable surface structure or reflector of reasonable size may include tens or hundreds of these tiny resonant elements. Each element may be connected to one or multiple electrically tunable capacitors which allow the reflection phase to be tuned as a function of position on the surface. This enables a reflected beam to be steered or focused in any direction by imparting a linear or curved slope on the reflection phase. FIG. 1B schematically depicts the variable capacitances 4 of the exemplary embodiment. In an exemplary embodiment, the tunable surface may be constructed using laminated layers of low loss dielectric materials to form a structure similar to a printed circuit board. The inner layers of the structure may contain signal routing, ground and power lines connected to the grid pattern of resonant electrodes 3 on the top surface. Between adjacent electrodes, a variable capacitor 4, e.g., a varactor, is electrically bonded. By applying bias voltages via the signal routing network to the electrodes a voltage pattern across the array is created. This voltage pattern applied to the electrode-spanning variable capacitors in turn creates an impedance pattern which enables beam steering.

Figure 2:
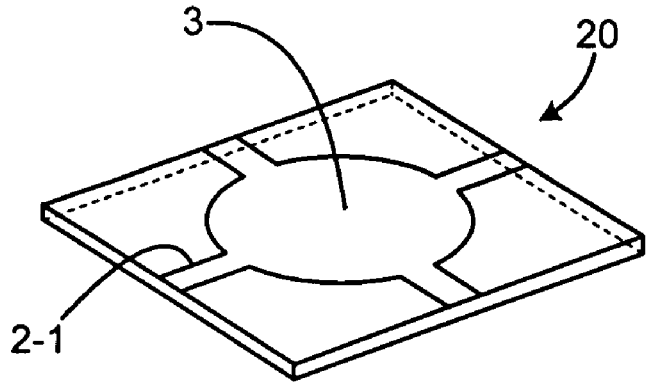
FIG. 2 is an isometric view of an exemplary embodiment of an electrode having a circular configuration.

If the geometry of the tunable surface is chosen such that the reflection phase changes by 2 $\pi$ within a fractional bandwidth or less than the bandwidth of the resonant reflector unit cell (an exemplary unit cell 20 is depicted in FIG. 2), then any desired phase can be achieved. For beam steering, since a total phase change of 2 $\pi$ is desired, the bandwidth of the tunable surface should be kept small by making the structure thin, typically a small fraction of the operating wavelength. Exemplary operating frequencies are from 100 MHz to 100 GHz.

FIG. 2 diagrammatically depicts a unit electrode cell 20, which includes an electrode portion 3 having a circular, flat, disc-like configuration in which the entire area circumscribed by the circular perimeter of the electrode portion is covered by an electrically conductive material or layer, and four equally spaced conductor strips 2-1 which project from the periphery of the electrode portion. The conductor strips 2-1 of adjacent electrode cells will be interconnected by the variable reactances, as described above. Typical unit cell disk electrode diameters are in the range of one third to one tenth of the operating wavelength, and more typically from one half to one tenth of the operating wavelength. At a 10 GHz operational frequency, for example, with a wavelength of 3 cm, the circular electrodes may be ~3 mm or less in diameter, in an exemplary embodiment, with the unit cell 20 having a cell length of 3 mm. Dimensions of the unit cell determine bandwidth support, i.e. the range of operating frequencies of the structure, loss, tuning/beam steering capability and resolution of the array (i.e. considering the unit cells as analogous to pixels on an LCD monitor, but where each cell reflects a portion of the incoming RF beam).

Figure 3:
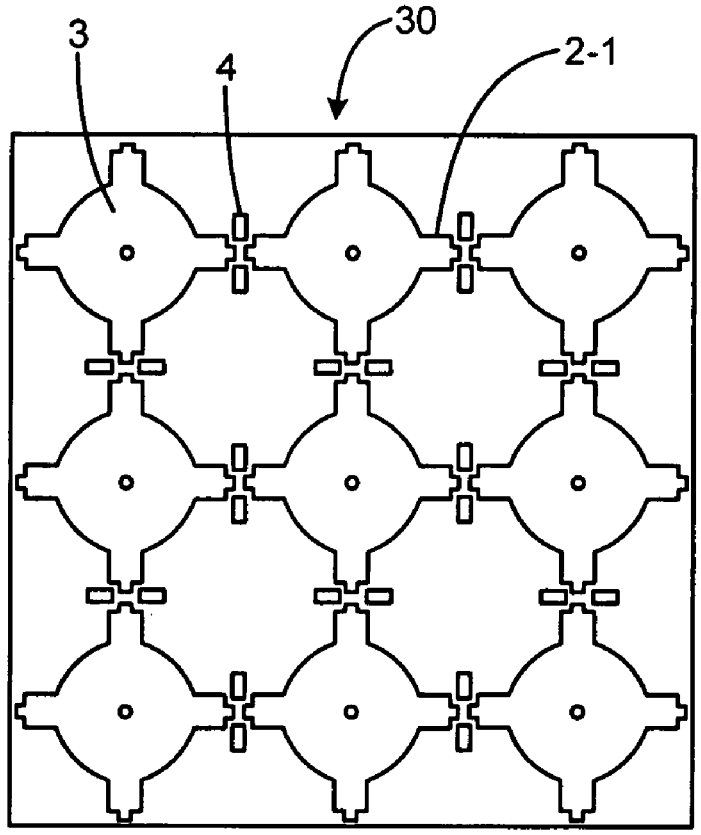
FIG. 3 is a diagrammatic view illustrating an exemplary embodiment of an array of circular electrodes for a tunable surface.

A high performance electrode geometry 30 for a tunable surface structure is illustrated in FIG. 3. This electrode geometry employs the unit cell 20 of FIG. 2 in a 3 by 3 cell arrangement, although the number of cells in a tunable surface will typically be much greater than nine. As shown in FIG. 3, corresponding ones of the conductor portions 2-1 of adjacent unit cells are interconnected by variable reactances such as varactors 4. The electrode geometry 30 has reduced edge parasitic capacitance compared to a square or rectangular electrode geometry and allows for greater capacitance tuning over a given frequency range. The circular geometry of the electrodes reduces overall electrode area and provides a low capacitance circular disk structure, with improved phase performance by increasing the phase tuning range of the resonant cells over a given voltage range relative to a square or rectangular electrode geometry. A large array of the circular electrode structures induces lower edge capacitance between neighboring cells. This geometry also enables higher frequency operation in the 10 GHz range, and has been simulated to show functionality up to 90 GHz.

In an exemplary embodiment, the circular configuration of the metal array elements enables much improved device performance in terms of reduced signal loss, greater phase range tuning capability, wider and more focused beam steering, and decreased signal sidelobes. One or more of these benefits may be realized by constructing the antenna array cell geometry with the circular configuration to minimize both substrate capacitance and parasitic capacitance between cell elements. Other techniques for achieving the lower substrate capacitance and parasitic capacitance between the cell elements include reducing substrate capacitance by changing substrate materials to lower loss and/or lower dielectric constant.

Figure 4:
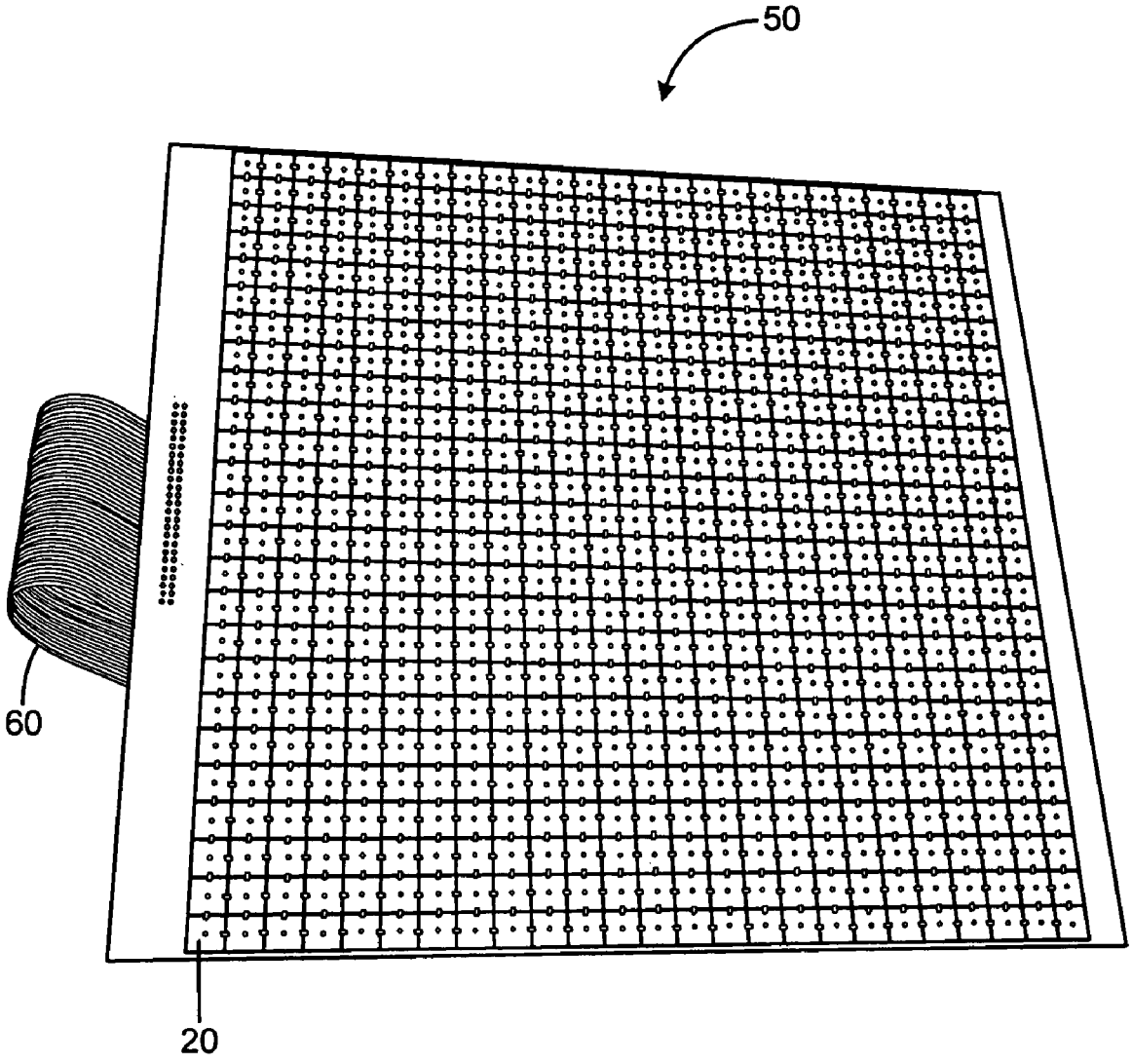
FIG. 4 illustrates an exemplary embodiment of a tunable microwave reflector.

FIG. 4 illustrates an exemplary embodiment of a microwave reflector 50 employing a tunable surface structure employing a pattern of adjacent unit electrode cells 20 with circular electrode geometry. A printed wiring circuit 60 may be employed to provide connections for RF, power and control signals. For simplicity, the circular electrodes are not specifically illustrated in FIG. 4.

Although the foregoing has been a description and illustration of specific embodiments of the invention, various modifications and changes thereto can be made by persons skilled in the art without departing from the scope and spirit of the invention as defined by the following claims.

What is claimed is:

1. An electronically tunable microwave reflector, comprising:

a ground plane, the ground plane having a ground plane surface;

an array of generally flat, circular disk metal electrodes arranged in a single layer of rows and columns in a two-dimensional lattice spaced vertically from the ground plane surface by a distance less than a wavelength of microwave energy to be reflected by the reflector, the electrodes having a diameter less than said wavelength, each of the electrodes being adjacent to up to two of the electrodes in a same one of the rows, adjacent to up to two of the electrodes in a same one of the columns, and diagonal to up to four of the electrodes in adjacent ones of the rows and columns;

a corresponding array of vertical three-dimensional conductor-free regions above the ground plane and between diagonal electrodes, the regions having a lattice cross-sectional area of at least one-half that of the electrodes;

a plurality of variable capacitance structures arranged for controllably varying a capacitance between adjacent ones of said electrodes;

a first array of conductors connecting a first set of the metal electrodes to the ground plane surface; and a second array of conductors connecting a second set of the metal electrodes to respective bias voltage sources.

2. The reflector of claim 1, further comprising a dielectric substrate having a top surface and a bottom surface, wherein:

the array of electrodes is disposed on the top surface;

the ground plane surface is disposed on the bottom surface;

the first array of conductors includes a first array of metal vias formed through the substrate, each respectively coupled between one of the first set of the electrodes and the ground plane surface; and the second array of conductors includes a second array of metal vias formed through the substrate, each respectively coupled between one of the second set of the electrodes and one of the respective bias voltage sources.

3. The reflector of claim 1, in which respective ones of the first set of the electrodes alternate with respective ones of the second set of the electrodes.

4. The reflector of claim 1, wherein the variable capacitance structures include varactor circuit devices.

5. The reflector of claim 1, wherein the electrode diameter is about 3 mm, and the reflector has an operating frequency at 10 GHz.

6. The reflector of claim 1, wherein the electrode diameter is in a range of one half to one tenth of said wavelength.

7. A tunable impedance surface structure for reflecting RF energy, comprising:

a dielectric substrate;

a ground plane having a ground plane surface arranged at a lower surface of the substrate;

a plurality of flat circular disk conductive electrodes arranged in a single layer of rows and columns on an upper surface of the substrate and spaced vertically from said ground plane by a distance less than a wavelength at an operating RF frequency, each of the electrodes being adjacent to up to two of the electrodes in a same one of the rows, adjacent to up to two of the electrodes in a same one of the columns, and diagonal to up to four of the electrodes in adjacent ones of the rows and columns;

a corresponding plurality of vertical three-dimensional conductor-free regions above the ground plane and between diagonal electrodes, the regions having a lattice cross-sectional area of at least one-half that of the electrodes;

a plurality of variable capacitance structures electrically connected between adjacent ones of the plurality of electrodes, said variable capacitance structures respectively arranged for controllably varying the capacitance between said adjacent electrodes;

a first array of conductors connecting a first set of the electrodes to the ground plane surface; and a second array of conductors connecting a second set of the electrodes to respective bias voltage sources, wherein the arrangement of the plurality of conductive electrodes, the plurality of vertical conductor-free regions, and the plurality of variable capacitance structures combine to provide low edge parasitic capacitance between adjacent electrodes and capacitance tuning over a frequency range of operation.

8. The structure of claim 7, wherein the plurality of conductive electrodes are arranged in a two-dimensional array.

9. The structure of claim 8, in which respective ones of the first set of the electrodes alternate with respective ones of the second set of the electrodes.

10. The structure of claim 7, wherein the variable capacitance structures include varactor circuit devices.

11. Original) The structure of claim 7, wherein the electrode diameter is about 3 mm, and the surface has an operating frequency at 10 GHz.

12. The structure of claim 7, wherein the electrode diameter is in a range of one half to one tenth of said operating wavelength.

13. A tunable impedance surface structure for reflecting, steering, or focusing electromagnetic energy, comprising:

an electrically conductive ground plane;

a plurality of flat circular disk electrically conductive electrodes arranged in a single layer of rows and columns in a two-dimensional lattice structure spaced vertically from said ground plane by a distance less than a wavelength at an operating frequency of the electromagnetic energy, each of the electrodes being adjacent to up to two of the electrodes in a same one of the rows, adjacent to up to two of the electrodes in a same one of the columns, and diagonal to up to four of the electrodes in adjacent ones of the rows and columns;

a corresponding plurality of vertical three-dimensional conductor-free regions above the ground plane and between diagonal electrodes, the regions having a lattice cross-sectional area of at least one-half that of the electrodes; and a plurality of variable capacitance structures electrically connected between adjacent ones of the plurality of electrodes, said variable capacitance structures respectively arranged for controllably varying the capacitance between said adjacent electrodes, wherein the arrangement of the plurality of conductive electrodes, the plurality of vertical conductor-free regions, and the plurality of variable capacitance structures combine to provide low edge parasitic capacitance between adjacent electrodes and capacitance tuning over a frequency range of operation, the electrodes have a diameter which is a fraction of said wavelength, and the electrodes are spaced from adjacent electrodes by a spacing distance which is less than said wavelength.

14. The structure of claim 13, wherein said two-dimensional lattice structure is defined by a closely packed arrangement of unit electrode cell structures, each comprising one of said electrodes, and wherein said cell structures have a unit cell length in a range of one half to one tenth of said wavelength.

15. The structure of claim 13, wherein the variable capacitance structures include varactor circuit devices.

* * * * *